US007242875B2

(12) United States Patent
Jones et al.

(10) Patent No.: US 7,242,875 B2
(45) Date of Patent: Jul. 10, 2007

(54) INDICATOR OF PROPERLY CURED INK FOR ELECTROPHOTOGRAPHIC EQUIPMENT

(75) Inventors: Kurt E. Jones, Webster, NY (US); Jerry A. Pickering, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 127 days.

(21) Appl. No.: 11/106,829

(22) Filed: Apr. 15, 2005

(65) Prior Publication Data

US 2005/0244171 A1 Nov. 3, 2005

Related U.S. Application Data

(60) Provisional application No. 60/567,086, filed on Apr. 30, 2004.

(51) Int. Cl.
*G03G 15/00* (2006.01)
*G03G 15/20* (2006.01)

(52) U.S. Cl. ..... 399/15; 399/324

(58) Field of Classification Search ..... 399/15, 399/98, 324; 347/156
See application file for complete search history.

(56) References Cited

U.S. PATENT DOCUMENTS 4,910,552 A * 3/1990 Migita et al. ..... 399/15
5,956,544 A 9/1999 Stern et al.
6,121,986 A 9/2000 Regelsberger et al.
6,757,500 B2 * 6/2004 Kuboki ..... 399/15
6,968,076 B1 * 11/2005 OuYang et al. ..... 399/15 X

FOREIGN PATENT DOCUMENTS

WO WO 01/89194 A2 11/2001
WO WO 02/10860 A1 2/2002
WO WO 02/14957 A1 2/2002

* cited by examiner

*Primary Examiner*—Sandra L. Brase
(74) *Attorney, Agent, or Firm*—Richard A. Romanchik

(57) ABSTRACT

A method of printing comprising the steps of marking the surface of a test preprinted media with a first marking material; placing the media adjacent to a transfer media; disposing the test media and the transfer media into the nip of a fuser roller assembly to thereby apply predetermined heat and pressure thereto; removing the test media and the transfer media from the nip of the fuser roller after a predetermined time; and, measuring the density of the first marking material which has been offset to the transfer media.

6 Claims, 4 Drawing Sheets

INDICATOR OF PROPERLY CURED INK FOR ELECTROPHOTOGRAPHIC EQUIPMENT

CROSS-REFERENCE TO RELATED APPLICATIONS

This application claims the benefit of the filing date of Provisional Application Ser. No. 60/567,086, entitled, "INDICATOR OF PROPERLY CURED INK FOR ELECTROPHOTOGRAPHIC EQUIPMENT", filed Apr. 30, 2004.

FIELD OF THE INVENTION

The present invention relates to printing on preprinted media, and more particularly to testing for print feasibility on preprinted media.

BACKGROUND

Electrographic printing (also referred to as electrographic marking, electrostatographic printing or marking, and electrophotographic printing or marking) has become the prevalent technology for modern computer-driven printing of text and images, on a wide variety of hard copy media. One type of such media is preprinted media, wherein the supplied media has print marking material already deposited thereon. Typical preprinted marking material includes inks, toners, paints, powders and the like.

One issue encountered with electrographic printing on preprinted media is that the preprinted marking material has a tendency to transfer to the fusing roller in the electrographic printer, thereby causing reliability issues.

Efforts regarding such printers or printing systems have led to continuing developments to improve their versatility practicality, and efficiency.

SUMMARY OF THE INVENTION

Embodiments of the present invention include a method of printing including the steps of marking the surface of a test preprinted media with a first marking material; placing the media adjacent to a transfer media; disposing the test media and the transfer media into the nip of a fuser roller assembly to thereby apply predetermined heat and pressure thereto; removing the test media and the transfer media from the nip of the fuser roller after a predetermined time; and, measuring the density of the first marking material which has been offset to the transfer media.

DETAILED DESCRIPTION

Figure 1A:
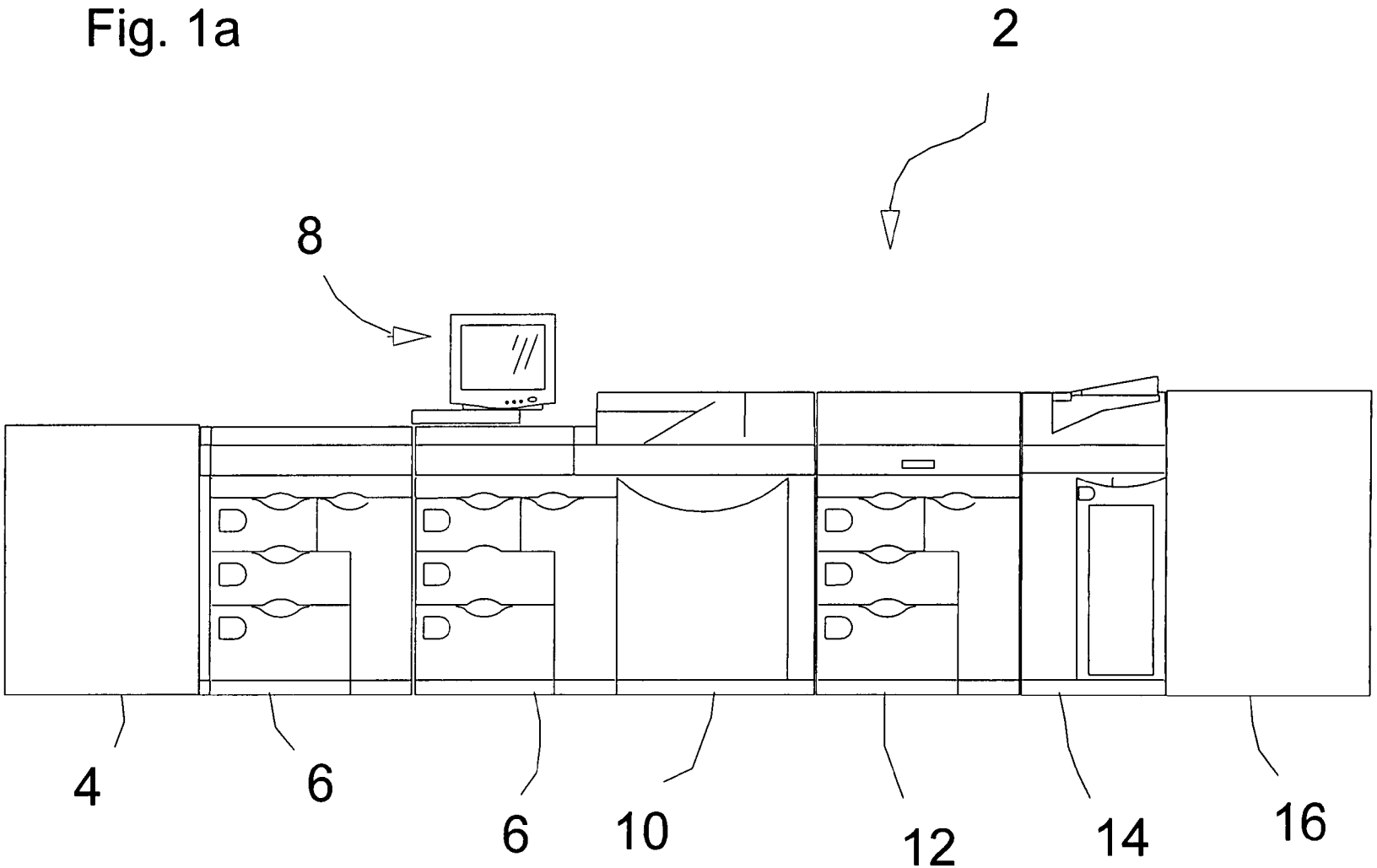
FIG. 1*a* is a schematic diagram of a marking or reproduction engine in accordance with the present invention.

Referring now to FIG. 1*a*, wherein a print system 2 is comprised of a media treatment system 4 for treating media to be printed. Media may include paper, cardboard, plastic, material, fabric, metal sheets, or any of a number of materials to which a marking material is to be adhered to in a predefined pattern or image. The media may be "heavy" media, or other types of media which are considered hard to print on. Heavy media is generally either thicker and/or more dense than media typically processed in the print engine. The media may also be the same or similar to typical media being used in the print job. The treated media is provided to a marking engine 10. Media to be printed on is also referred to as a receiver. For exemplary purposes, a media supply 6 is shown, wherein the treated media, and perhaps other media is stacked in trays or otherwise organized. The print system is controlled via a user interface 8 which may be remotely located from the print engine 10. The printed media is supplied to a stacking device 12, 14 and/or a finishing device 16.

Figure 1B:
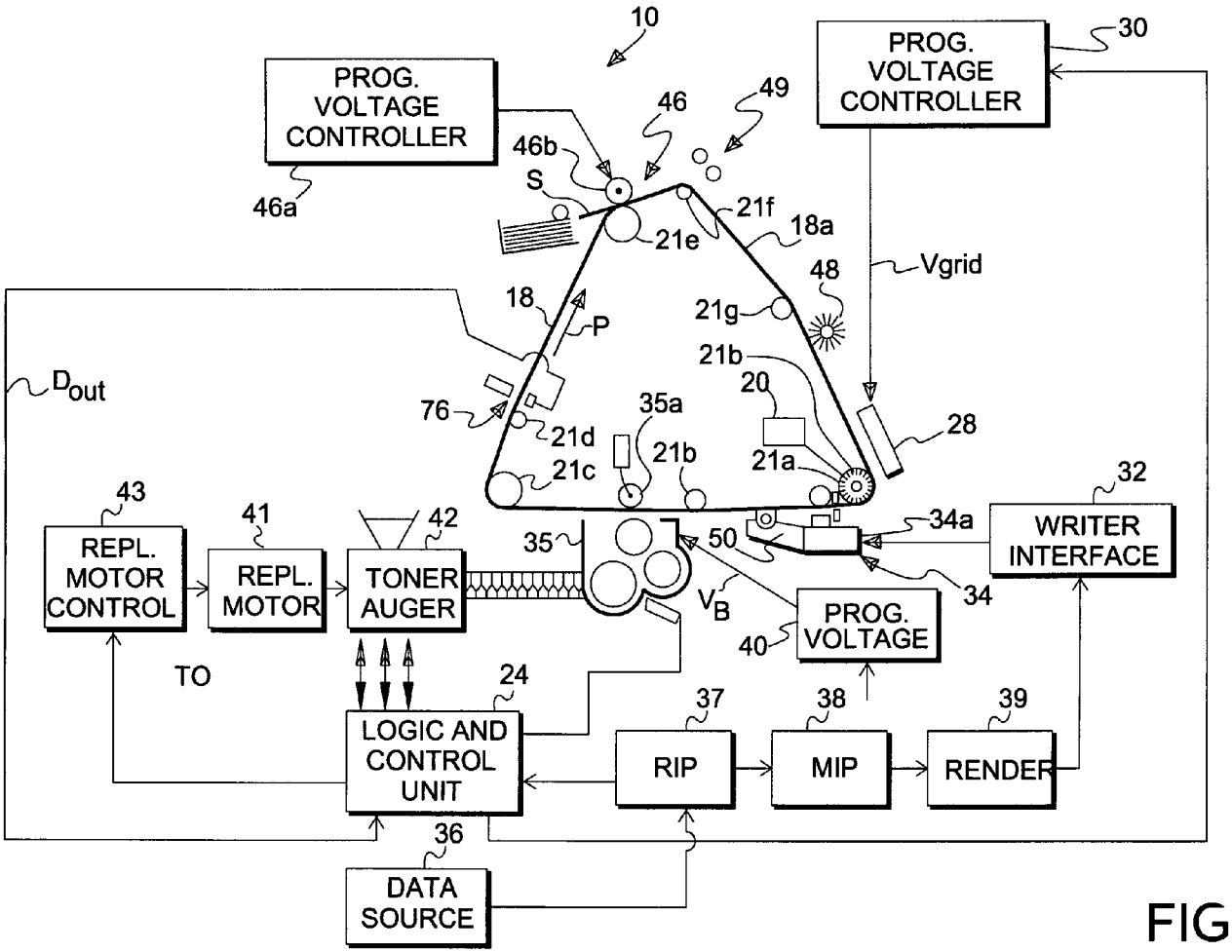
FIG. 1*b* is a schematic diagram of an electrographic marking or reproduction system in accordance with the present invention.

Referring to FIG. 1*b*, the printer or marking engine 10 is an electrostatographic printer, and includes a moving recording member such as a photoconductive belt 18 which is entrained about a plurality of rollers or other supports 21*a* through 21*g*, one or more of which is driven by a motor to advance the belt. By way of example, roller 21*a* is illustrated as being driven by motor 20. Motor 20 preferably advances the belt at a high speed, such as 20 inches per second or higher, in the direction indicated by arrow P, past a series of workstations of the printer 10. Alternatively, belt 18 may be wrapped and secured about only a single drum.

Printer 10 includes a controller or logic and control unit (LCU) 24, preferably a digital computer or microprocessor operating according to a stored program for sequentially actuating the workstations within printer 10, effecting overall control of printer 10 and its various subsystems. LCU 24 also is programmed to provide closed-loop control of printer 10 in response to signals from various sensors and encoders. Aspects of process control are described in U.S. Pat. No. 6,121,986 incorporated herein by this reference.

A primary charging station 28 in printer 10 sensitizes belt 18 by applying a uniform electrostatic corona charge, from high-voltage charging wires at a predetermined primary voltage, to a surface 18*a* of belt 18. The output of charging station 28 is regulated by a programmable voltage controller 30, which is in turn controlled by LCU 24 to adjust this primary voltage, for example by controlling the electrical potential of a grid and thus controlling movement of the corona charge. Other forms of chargers, including brush or roller chargers, may also be used.

An exposure station 34 in printer 10 projects light from a writer 34*a* to belt 18. This light selectively dissipates the electrostatic charge on photoconductive belt 18 to form a latent electrostatic image of the document to be copied or printed. Writer 34*a* is preferably constructed as an array of light emitting diodes (LEDs), or alternatively as another light source such as a laser or spatial light modulator. Writer 34*a* exposes individual picture elements (pixels) of belt 18 with light at a regulated intensity and exposure, in the manner described below. The exposing light discharges selected pixel locations of the photoconductor, so that the pattern of localized voltages across the photoconductor corresponds to the image to be printed. An image is a pattern of physical light which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

Image data to be printed is provided by an image data source 36, which is a device that can provide digital data defining a version of the image. Such types of devices are numerous and include computer or microcontroller, computer workstation, scanner, digital camera, etc. These data represent the location and intensity of each pixel that is exposed by the printer. Signals from data source 36, in combination with control signals from LCU 24 are provided to a raster image processor (RIP) 37. The digital images (including styled text) are converted by the RIP 37 from their form in a page description language (PDL) language to a sequence of serial instructions for the electrographic printer in a process commonly known as "ripping" and which provides a ripped image to a image storage and retrieval system known as a Marking Image Processor (MIP) 38.

In general, the major roles of the RIP 37 are to: receive job information from the server; parse the header from the print job and determine the printing and finishing requirements of the job; analyze the PDL (Page Description Language) to reflect any job or page requirements that were not stated in the header; resolve any conflicts between the requirements of the job and the marking engine configuration (i.e., RIP time mismatch resolution); keep accounting record and error logs and provide this information to any subsystem, upon request; communicate image transfer requirements to the marking engine; translate the data from PDL (Page Description Language) to raster for printing; and support diagnostics communication between user applications. The RIP accepts a print job in the form of a Page Description Language (PDL) such as PostScript, PDF or PCL and converts it into raster, a form that the marking engine can accept. The PDL file received at the RIP describes the layout of the document as it was created on the host computer used by the customer. This conversion process is called rasterization. The RIP makes the decision on how to process the document based on what PDL the document is described in. It reaches this decision by looking at the first 2 K of the document. A job manager sends the job information to a MSS (Marking Subsystem Services) via Ethernet and the rest of the document further into the RIP to get rasterized. For clarification, the document header contains printer-specific information such as whether to staple or duplex the job. Once the document has been converted to raster by one of the interpreters, the Raster data goes to the MIP 38 via RTS (Raster Transfer Services); this transfers the data over a IDB (Image Data Bus).

The MIP functionally replaces recirculating feeders on optical copiers. This means that images are not mechanically rescanned within jobs that require rescanning, but rather, images are electronically retrieved from the MIP to replace the rescan process. The MIP accepts digital image input and stores it for a limited time so it can be retrieved and printed to complete the job as needed. The MIP consists of memory for storing digital image input received from the RIP. Once the images are in MIP memory, they can be repeatedly read from memory and output to the Render Circuit. The amount of memory required to store a given number of images can be reduced by compressing the images; therefore, the images are compressed prior to MIP memory storage, then decompressed while being read from MIP memory.

The output of the MIP is provided to an image render circuit 39, which alters the image and provides the altered image to the writer interface 32 (otherwise known as a write head, print head, etc.) which applies exposure parameters to the exposure medium, such as a photoconductor 18.

After exposure, the portion of exposure medium belt 18 bearing the latent charge images travels to a development station 35. Development station 35 includes a magnetic brush in juxtaposition to the belt 18. Magnetic brush development stations are well known in the art, and are preferred in many applications; alternatively, other known types of development stations or devices may be used. Plural development stations 35 may be provided for developing images in plural colors, or from toners of different physical characteristics. Full process color electrographic printing is accomplished by utilizing this process for each of four toner colors (e.g., black, cyan, magenta, yellow).

Upon the imaged portion of belt 18 reaching development station 35, LCU 24 selectively activates development station 35 to apply toner to belt 18 by moving backup roller 35*a* belt 18, into engagement with or close proximity to the magnetic brush. Alternatively, the magnetic brush may be moved toward belt 18 to selectively engage belt 18. In either case, charged toner particles on the magnetic brush are selectively attracted to the latent image patterns present on belt 18, developing those image patterns. As the exposed photoconductor passes the developing station, toner is attracted to pixel locations of the photoconductor and as a result, a pattern of toner corresponding to the image to be printed appears on the photoconductor. As known in the art, conductor portions of development station 35, such as conductive applicator cylinders, are biased to act as electrodes. The electrodes are connected to a variable supply voltage, which is regulated by programmable controller 40 in response to LCU 24, by way of which the development process is controlled.

Development station 35 may contain a two component developer mix which comprises a dry mixture of toner and carrier particles. Typically the carrier preferably comprises high coercivity (hard magnetic) ferrite particles. As an example, the carrier particles have a volume-weighted diameter of approximately 30μ. The dry toner particles are substantially smaller, on the order of 6μ to 15μ in volume-weighted diameter. Development station 35 may include an applicator having a rotatable magnetic core within a shell, which also may be rotatably driven by a motor or other suitable driving means. Relative rotation of the core and shell moves the developer through a development zone in the presence of an electrical field. In the course of development, the toner selectively electrostatically adheres to photoconductive belt 18 to develop the electrostatic images thereon and the carrier material remains at development station 35. As toner is depleted from the development station due to the development of the electrostatic image, additional toner is periodically introduced by toner auger 42 (which is driven by a motor 41 controlled by controller 43) into development station 35 to be mixed with the carrier particles to maintain a uniform amount of development mixture. This development mixture is controlled in accordance with various development control processes. Single component developer stations, as well as conventional liquid toner development stations, may also be used.

A transfer station 46 in marking engine 10 moves a receiver sheet S into engagement with photoconductive belt 18, in registration with a developed image to transfer the developed image to receiver sheet S. Receiver sheets S may be plain or coated paper, plastic, or another medium capable of being handled by printer 10. Typically, transfer station 46 includes a charging device for electrostatically biasing movement of the toner particles from belt 18 to receiver sheet S. In this example, the biasing device is roller 46*b*, which engages the back of sheet S and which is connected to programmable voltage controller 46*a* that operates in a constant current mode during transfer. Alternatively, an intermediate member may have the image transferred to it and the image may then be transferred to receiver sheet S. After transfer of the toner image to receiver sheet S, sheet S is detacked from belt 18 and transported to fuser station 49 where the image is fixed onto sheet S, typically by the application of heat. Alternatively, the image may be fixed to sheet S at the time of transfer.

A cleaning station 48, such as a brush, blade, or web is also located behind transfer station 46, and removes residual toner from belt 18. A pre-clean charger (not shown) may be located before or at cleaning station 48 to assist in this cleaning. After cleaning, this portion of belt 18 is then ready for recharging and re-exposure. Of course, other portions of belt 18 are simultaneously located at the various workstations of marking engine 10, so that the printing process is carried out in a substantially continuous manner.

LCU 24 provides overall control of the apparatus and its various subsystems as is well known. LCU 24 will typically include temporary data storage memory, a central processing unit, timing and cycle control unit, and stored program control. Data input and output is performed sequentially through or under program control. Input data can be applied through input signal buffers to an input data processor, or through an interrupt signal processor, and include input signals from various switches, sensors, and analog-to-digital converters internal to marking engine 10, or received from sources external to marking engine 10, such from as a human user or a network control. The output data and control signals from LCU 24 are applied directly or through storage latches to suitable output drivers and in turn to the appropriate subsystems within marking engine 10.

Process control strategies generally utilize various sensors to provide real-time closed-loop control of the electrostatographic process so that marking engine 10 generates "constant" image quality output, from the user's perspective. Real-time process control is necessary in electrographic printing, to account for changes in the environmental ambient of the photographic printer, and for changes in the operating conditions of the printer that occur over time during operation (rest/run effects). An important environmental condition parameter requiring process control is relative humidity, because changes in relative humidity affect the charge-to-mass ratio Q/m of toner particles. The ratio Q/m directly determines the density of toner that adheres to the photoconductor during development, and thus directly affects the density of the resulting image. System changes that can occur over time include changes due to aging of the printhead (exposure station), changes in the concentration of magnetic carrier particles in the toner as the toner is depleted through use, changes in the mechanical position of primary charger elements, aging of the photoconductor, variability in the manufacture of electrical components and of the photoconductor, change in conditions as the printer warms up after power-on, triboelectric charging of the toner, and other changes in electrographic process conditions. Because of these effects and the high resolution of modern electrographic printing, the process control techniques have become quite complex.

Process control sensor may be a densitometer 76, which monitors test patches that are exposed and developed in non-image areas of photoconductive belt 18 under the control of LCU 24. Densitometer 76 may include a infrared or visible light LED, which either shines through the belt or is reflected by the belt onto a photodiode in densitometer 76. These toned test patches are exposed to varying toner density levels, including full density and various intermediate densities, so that the actual density of toner in the patch can be compared with the desired density of toner as indicated by the various control voltages and signals. These densitometer measurements are used to control primary charging voltage $V_O$, maximum exposure light intensity $E_O$, and development station electrode bias $V_B$. In addition, the process control of a toner replenishment control signal value or a toner concentration setpoint value to maintain the charge-to-mass ratio Q/m at a level that avoids dusting or hollow character formation due to low toner charge, and also avoids breakdown and transfer mottle due to high toner charge for improved accuracy in the process control of marking engine 10. The toned test patches are formed in the interframe area of belt 18 so that the process control can be carried out in real time without reducing the printed output throughput. Another sensor useful for monitoring process parameters in printer 10 is electrometer probe 50, mounted downstream of the corona charging station 28 relative to direction P of the movement of belt 18. An example of an electrometer is described in U.S. Pat. No. 5,956,544 incorporated herein by this reference.

Other approaches to electrographic printing process control may be utilized, such as those described in International Publication Number WO 02/10860 A1, and International Publication Number WO 02/14957 A1, both commonly assigned herewith and incorporated herein by this reference.

Raster image processing begins with a page description generated by the computer application used to produce the desired image. The raster image processor interprets this page description into a display list of objects. This display list contains a descriptor for each text and non-text object to be printed; in the case of text, the descriptor specifies each text character, its font, and its location on the page. For example, the contents of a word processing document with styled text is translated by the RIP into serial printer instructions that include, for the example of a binary black printer, a bit for each pixel location indicating whether that pixel is to be black or white. Binary print means an image is converted to a digital array of pixels, each pixel having a value assigned to it, and wherein the digital value of every pixel is represented by only two possible numbers, either a one or a zero. The digital image in such a case is known as a binary image. Multi-bit images, alternatively, are represented by a digital array of pixels, wherein the pixels have assigned values of more than two number possibilities. The RIP renders the display list into a "contone" (continuous tone) byte map for the page to be printed. This contone byte map represents each pixel location on the page to be printed by a density level (typically eight bits, or one byte, for a byte map rendering) for each color to be printed. Black text is generally represented by a full density value (255, for an eight bit rendering) for each pixel within the character. The byte map typically contains more information than can be used by the printer. Finally, the RIP rasterizes the byte map into a bit map for use by the printer. Half-tone densities are formed by the application of a halftone "screen" to the byte map, especially in the case of image objects to be printed. Pre-press adjustments can include the selection of the particular halftone screens to be applied, for example to adjust the contrast of the resulting image.

When running preprinted media in an electrographic marking engine, the marking material on the preprinted media, such as uncured ink, may contaminate the components, such as the fuser roller assembly, of the electrographic marking engine. Ink may consist of colorants (pigments dyes, fillers), binders (natural and artificial resins, substitute material greases, oils, etc.), additives (agents preventing skin formation, coalescing agents, wetting agents, biocides, siccatives, waxes, etc.), and a carrier substance (solvents, mineral oils or vegetable oils such as soy bean oil).

Figure 2:
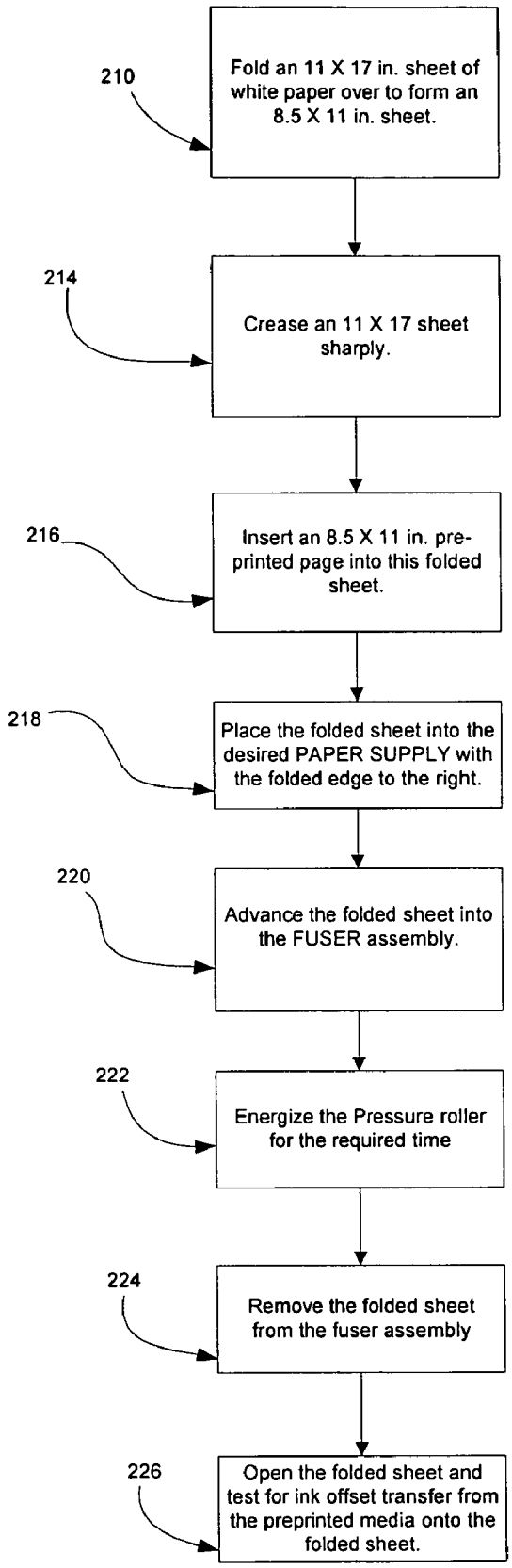
FIG. 2 is a flow chart of a routine for testing print feasibility.

Referring now to FIG. 2, a routine for testing print feasibility of preprinted media begins with a step 210, wherein a 11×17 in. transfer sheet of white paper is folded over to form an 8.5×11 in. pocket, which is creased in a step 214. In a step 216, an 8.5×11 in. test sheet of pre-printed media is placed in the pocket of the folded sheet. In a step 218, the two sheets are placed into the desired paper supply with the folded edge facing the direction of paper travel. In a step 220, the folded sheet is advanced into the fuser assembly. In a step 222, the pressure roller is heated to a predetermined temperature for a predetermined time. In a step 224, the folded sheet is removed from the fuser assembly. In a step 226, the folded sheet is then opened and tested for ink offset transfer from the preprinted media onto the folded sheet. A densitometer may be used to accomplish the testing. During the test, the heat and pressure applied by the fuser assembly may have caused transfer of marking material from the preprinted media to the middle test sheet. The amount of ink offset thereto is used as an indicator to determine the cure level of the preprinted marking material and thus the feasibility of running the preprinted media in the electrographic marking engine without undue contamination. The amount of ink offset may also be used to estimate the number of prints that can be run through the electrographic engine before contamination requires replacement or cleaning of certain parts, such as the fuser roller.

The following Table illustrates density parameters and conditions of print feasibility.

Levels of Offset For Coated Papers

| Offset Dt | Cure Level | Comments | Recommendations |
|---|---|---|---|
| No Ink Offset | High | Best chance for successful running | Run material |
| Slight Offset (Offset Dt Range - Visible offset to +0.01 of paper Dt) | Medium | May need to replace fuser components prior to part life | Wait 24 hr and repeat the test. If the offset has not improved, repeat the 24 hr wait and perform the test again. The operator must monitor the fuser components if the pre-print is run with the offset Dt higher then the Paper Dt |
| Heavy Offset (Offset Dt □ 0.02 of Paper Dt) | Low | High probability of short fuser part life | Wait 72 hr and repeat the test. If the offset has not improved, repeat the 72 hr wait and perform the test again. The operator must monitor the fuser components if the pre-print is run with the offset Dt higher then the Paper Dt |

Figure 3:
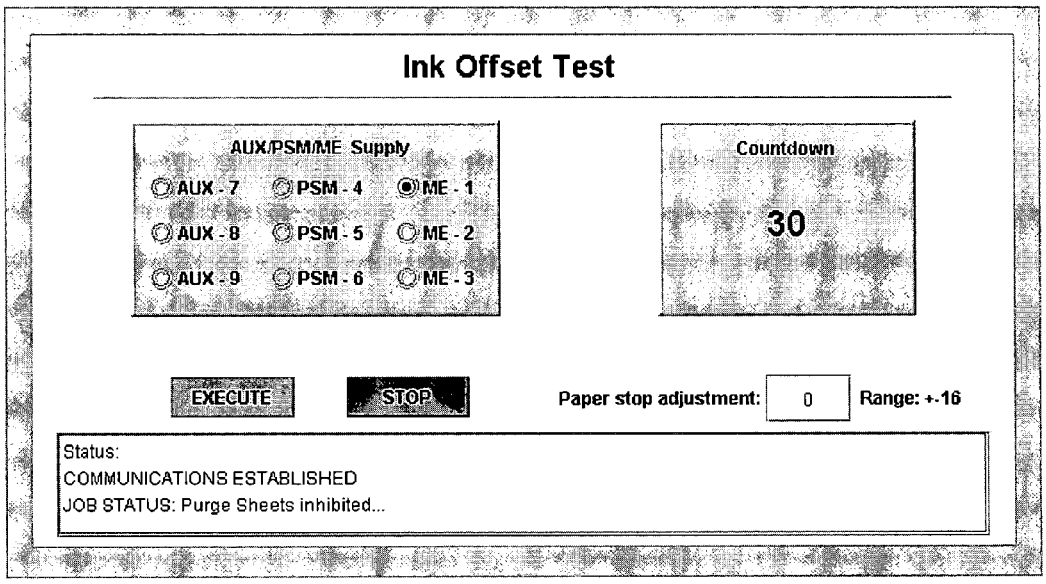
FIG. 3 is a screen shot on the graphic user interface in accordance with the invention.

Referring now to FIG. 3, a screen shot may be created on the graphic user interface of the printer to guide an operator through the test of the present invention. To this end, the printer controller may be programmed to carry out part of or the entire test described herein. For instance, the controller may automatically move the test media and transfer media from the input tray into the fuser assembly nip, energize the fuser assembly to treat the two with heat and pressure, move the test sample out of the nip, test the ink offset density, and recommend or control further printing parameters based on the ink offset density.

Although the invention has been shown and described with exemplary embodiments thereof, it should be understood by those skilled in the art that the foregoing and various other changes, omissions and additions may be made therein and thereto without departing from the spirit and scope of the invention.

It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. While various elements of the preferred embodiments have been described as being implemented in software, in other embodiments hardware or firmware implementations may alternatively be used, and vice-versa.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more, fewer or other elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

PARTS LIST

2 print system
4 media treatment system
6 media supply
8 user interface
10 marking engine

12, 14 stacking device
16 finishing device
18 photoconductive brush
18*a* surface
20 motor
21*a* roller
21*a*-21*g* supports
24 logic and control unit
28 primary charging station
30 programmable voltage controller
32 writer interface
34 exposure station
34*a* writer
36 image data source
37 raster image processor
38 marking image processor
39 image render circuit
40 programmable controller
42 toner auger
46 transfer station
46*a* programmable voltage controller
46*b* roller
48 cleaning station
49 fuser station
50 electrometer probe
76 densitometer
210 step
214 step
216 step
218 step
220 step
222 step
224 step
P direction/arrow
S receiver sheet

The invention claimed is:

1. A method of printing comprising the steps of:

marking the surface of a test preprinted media with a marking material;

placing the media adjacent to a transfer media;

disposing the test media and the transfer media into the nip of a fuser roller assembly to thereby apply predetermined heat and pressure thereto;

removing the test media and the transfer media from the nip of the fuser roller after a predetermined time; and measuring the density of the marking material which has been offset to the transfer media.

2. The method of claim 1, further comprising the step of determining the feasibility of printing a second marking material onto the preprinted media based on the measured density.

3. The method of claim 1, further comprising the step of calculating the number of feasible prints for printing a second marking material onto the preprinted media based on the measured density.

4. A printer comprising:

an input tray for holding test preprinted media marked with a marking material adjacent to a transfer media; and a controller for controlling a movement of the test media and the transfer media into the nip of a fuser roller assembly, energizing the fuser roller assembly to apply predetermined heat and pressure thereto, moving the test media and the transfer media out of the nip of the fuser roller after a predetermined time and measuring the density of the marking material which has been offset to the transfer media.

5. The printer of claim 4, wherein the controller determines the feasibility of printing a second marking material onto the preprinted media based on the measured density.

6. The printer of claim 4, wherein the controller calculates the number of feasible prints for printing a second marking material onto the preprinted media based on the measured density.

* * * * *